US010343829B2

(12) United States Patent
Zacherle et al.

(10) Patent No.: US 10,343,829 B2
(45) Date of Patent: Jul. 9, 2019

(54) PAPERBOARD CARTON AND CARTON BLANK

(71) Applicant: WestRock Packaging Systems, LLC, Norcross, GA (US)

(72) Inventors: Matthew E. Zacherle, Chesterfield, VA (US); Ekaterina V. Gaidaeva, Richmond, VA (US)

(73) Assignee: WestRock Packaging Systems, LLC, Atlanta, GA (US)

( * ) Notice: Subject to any disclaimer, the term of this patent is extended or adjusted under 35 U.S.C. 154(b) by 0 days.

(21) Appl. No.: 15/546,701

(22) PCT Filed: Jan. 28, 2016

(86) PCT No.: PCT/US2016/015336
§ 371 (c)(1),
(2) Date: Jul. 27, 2017

(87) PCT Pub. No.: WO2016/123325
PCT Pub. Date: Aug. 4, 2016

(65) Prior Publication Data

US 2018/0016073 A1 Jan. 18, 2018

Related U.S. Application Data

(60) Provisional application No. 62/109,197, filed on Jan. 29, 2015.

(51) Int. Cl.

| | |
|---|---|
| ***B65D 71/18*** | (2006.01) |
| ***B65D 5/04*** | (2006.01) |
| ***B65D 85/72*** | (2006.01) |

(52) U.S. Cl.
CPC ..... *B65D 71/18* (2013.01); *B65D 5/04* (2013.01); *B65D 85/72* (2013.01);
(Continued)

(58) Field of Classification Search
CPC ..... B65D 71/18; B65D 5/04; B65D 85/72; B65D 71/36; B65D 2571/00759; B65D 71/16; B65D 2571/00456
(Continued)

(56) References Cited

U.S. PATENT DOCUMENTS 2,637,476 A 5/1953 Empkie
4,381,057 A * 4/1983 Carver ..... B65D 71/16 206/426
(Continued)

FOREIGN PATENT DOCUMENTS

DE 20200500949 U1 3/2005
FR 1307325 A 10/1962
(Continued)

*Primary Examiner* — Christopher R Demeree
(74) *Attorney, Agent, or Firm* — WestRock Intellectual Property Group

(57) ABSTRACT

A carton for packaging articles includes top (14A, 14B) and bottom (18, 20) connected together by spaced side walls (12A, 12B, 12C; 16A, 16B, 16C) to form a tubular structure, and an end closure structure (22) at one end of the tubular structure. Each end closure structure includes first and second top flaps (32*a*, 32*b*) connected to the top (14A, 14B) and interconnected to anchoring panels (24*a*, 24*b*). The top flaps are not directly connected together but through the top of the carton.

16 Claims, 5 Drawing Sheets

(52) U.S. Cl.
CPC ..... *B65D 2571/0016* (2013.01); *B65D 2571/0029* (2013.01); *B65D 2571/00222* (2013.01); *B65D 2571/00265* (2013.01); *B65D 2571/00716* (2013.01); *B65D 2571/00728* (2013.01); *B65D 2571/00759* (2013.01)

(58) Field of Classification Search
USPC ..... 229/103.2; 206/427, 434
See application file for complete search history.

(56) References Cited

U.S. PATENT DOCUMENTS

| | | | | |
|---|---|---|---|---|
| 6,315,111 | B1 * | 11/2001 | Sutherland | B65D 71/0055 206/188 |
| 8,347,591 | B2 * | 1/2013 | Coltri-Johnson | B65B 5/024 53/456 |
| 8,496,162 | B2 * | 7/2013 | Hettinger | B65D 71/14 206/139 |
| 8,997,986 | B2 * | 4/2015 | Spivey, Sr. | B65D 71/18 206/147 |
| 2007/0241017 | A1 | 10/2007 | Sutherland | |

FOREIGN PATENT DOCUMENTS

| | | | |
|---|---|---|---|
| FR | 2148917 | A5 | 3/1973 |
| WO | WO 2009/064976 | A1 | 5/2009 |

* cited by examiner

PAPERBOARD CARTON AND CARTON BLANK

TECHNICAL FIELD

The present invention relates to a carton and blank for forming the same and more specifically, but not exclusively, to a carton having a substantially tubular structure. The carton is of a wraparound type and optionally having means for automatically folding an end panel so as to at least partially close an end of the tubular structure.

BACKGROUND OF THE INVENTION

Wraparound type carton blanks typically include a plurality of panels foldably hinged to each other for forming top, bottom, and side walls. It is also known to provide an end closure structure of at least partially closing the end of the wraparound carton such as the carton shown in patents U.S. Pat. No. 5,180,054 to Bakx and U.S. Pat. No. 8,496,162 to Hettinger.

It is desirable to increase the security of the articles within the carton to prevent theft of the articles from the carton

SUMMARY

According to a first aspect of the invention there is provided a carton for packaging a plurality of articles, the carton including top and bottom panels connected together by spaced side wall panels to form a tubular structure; an end closure structure for at least partially closing one of opposed ends of the tubular structure, the end closure structure including an upper end closure panel connected to the top panel at a respective one of opposed ends of the top panel; wherein said upper end closure panel includes first and second flaps hingedly connected to the respective one of the opposed ends of the top panel, and the first flap is not directly connected to the second flap.

According to a second aspect of the invention there is provided a blank for forming a carton for packaging a plurality of articles, the blank including a top panel and at least one bottom panel connected together by at least one side wall panel for forming a tubular structure; and an end closure structure for at least partially closing one of opposed ends of the tubular structure when the blank is erected into a carton, the end closure structure including an upper end closure panel connected to the top panel at a respective one of opposed ends of the top panel, wherein the upper end closure panel includes first and second flaps hingedly connected to the respective one of the opposed ends of the top panel, and the first and second flaps are not directly connected to one another.

BRIEF DESCRIPTION OF THE DRAWINGS

Exemplary embodiments of the invention will now be described with reference to the accompanying drawings in which.

DETAILED DESCRIPTION OF THE INVENTION

Figure 1:
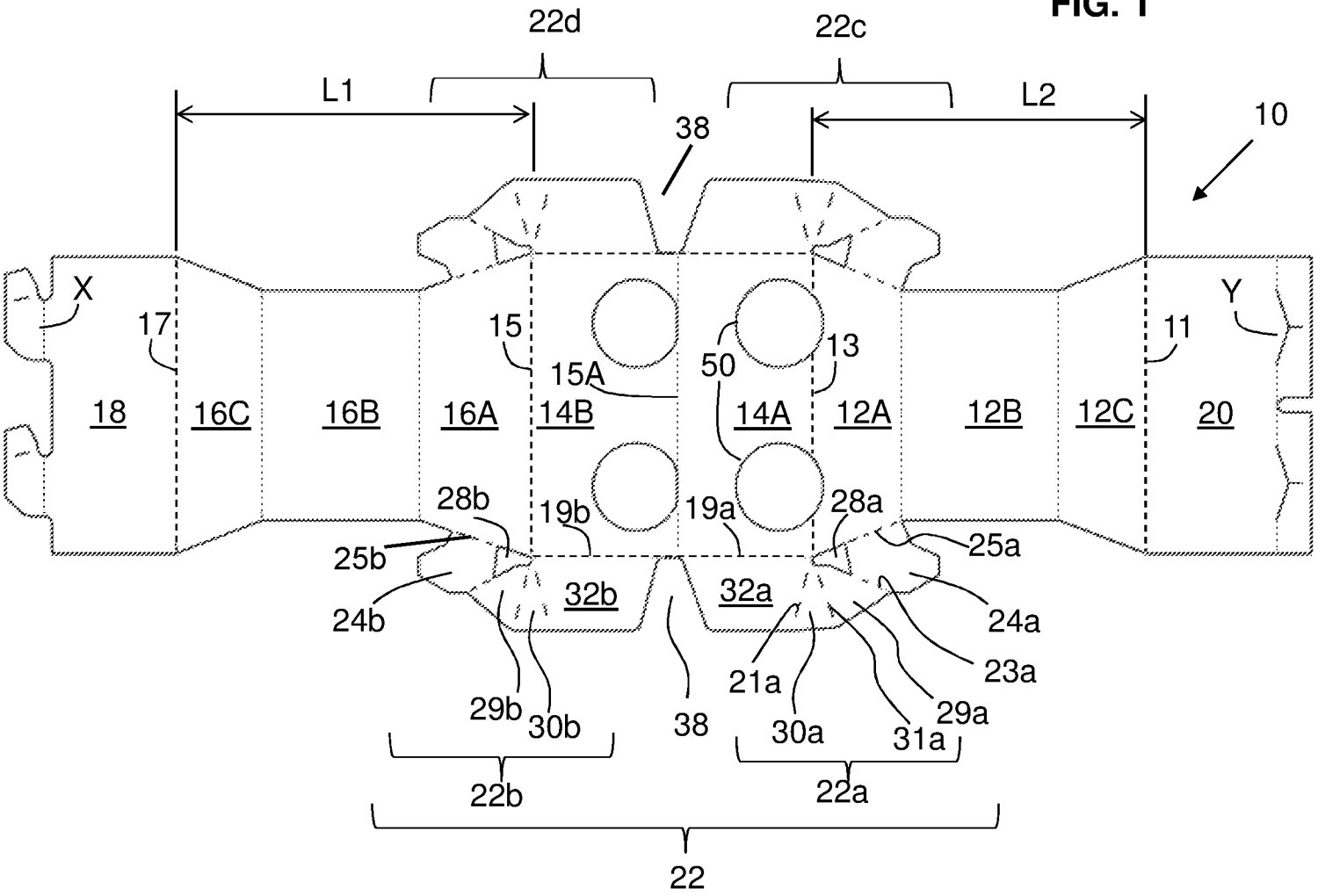
FIG. 1 illustrates a plan view of a blank for making a paperboard carton.

FIG. 1 shows a blank 10 for forming a carton 90. The blank 10 includes a plurality of panels 20, 12C, 12B, 12A, 14A, 14B, 16A, 16B, 16C, 18 for forming, when the blank is erected; a bottom 18, 20, a first side wall 16A, 16B, 16C, a second side wall 12A, 12B, 12C and a top 14A, 14B. The first side wall, the second side wall and the top each is formed from two or more of the panels. However, the first side wall, the second side wall and the top will hereinafter be denoted cumulatively by reference numerals "16", "12" and "14", respectively.

The plurality of panels 20, 12A, 12B, 12C, 14A, 14B, 16A, 16B, 16C, 18 are folded about a group of articles (such as beverage brick packs A shown in FIGS. 5A and 5B) to cluster those articles into one unitary package. The panels are disposed along the exterior of the group of articles such that the top 14 is placed on top of the articles group and the side walls 12, 16 are disposed alongside the opposite sides of the article group. The bottom 18, 20 is placed under the article group in such a condition where the bottom panels 18, 20 are secured together either by means of adhesive or of a mechanical lock. In the illustrated example, the bottom panels 18, 20 are secured by a mechanical lock, which will be described later in more details.

Certain of the fold lines are enumerated in FIG. 1, including fold line 11 between bottom panel 20 and lower side wall panel 12C; fold line 13 between upper side wall panel 12A and top panel 14A; fold line 15 between top panel 14B and upper side wall panel 16A, and fold line 17 between lower side wall panel 16C and bottom panel 18.

Bottom panels 18 and 20 overlap to form a composite bottom 18, 20 that may be secured together using mechanical locking means X, Y or adhesive securing means known in the art.

Hingedly attached to top 14 at each end of the blank is an end closure structure 22. Each end closure structure comprises two sections 22*a*, 22*b* (or 22*c*, 22*d*). The sections of the end closure structures are substantially the same in construction; therefore only one section 22*a* will be described in detail.

The section 22*a* includes a top flap 32*a* hinged to top panel 14A along fold line 19*a*. The top flap 32*a* is hinged to first gusset panel 30*a* along fold line 21*a*. Gusset panel 30*a* is in turn hinged to second gusset panel 29*a* along fold line 31*a*. Second gusset panel 29*a* is then hinged to anchoring panel 24*a* along fold line 23*a*.

Anchoring panel 24*a* is then hinged to side wall 12 along fold line 25*a*. Aperture 28*a* is struck from blank 10 near the intersections of the fold lines between the top panel 14A, upper side wall panel 12A, and top flap 32*a*, first gusset panel 30*a*, second gusset panel 29*a*, and anchoring panel 24*a*. The apertures 28*a* facilitate folding of the section 22*a* of the respective end closure structure 22.

A gap 38 is provided between flaps 32*a*, 32*b*. Although gap 38 is shown provided by a cutout by having material removed from the blank between top flaps 32*a*, 32*b*, the gap 38 may alternatively and optionally be provided by having simply a discontinuity, such as a slit or cut, between top flaps 32*a*, 32*b* to permit them to move independently in the finished carton 90.

Partial cuts may be made along any of the fold lines to facilitate folding of the fold lines. In the preferred embodiment gusset panels 29*a*, 30*a* and anchoring panel 24*a* may be substantially triangular in shape.

Top 14 includes top-receiving apertures 50 each may be sized and shaped to accommodate a cap, neck or otherwise top portion of the respective article. Each illustrated aperture 15 is circular or generally circular in shape to receive a rounded cap of a brick pack. However, the shape of each aperture may, for example, be oval or polygonal. The top panels 14A, 14B are hingedly connected along a fold line 15A such that the fold line 15A extends across top 14 between the gaps 38, 38 when the blank is erected into a carton. The fold line 15A may optionally be closely adjacent two of the top-receiving apertures 50 such that the fold line 15A is in tangential contact with those top-receiving apertures 50 or it defines part of the respective outlines of those apertures 50.

FIGS. 2 to 5 illustrate assembly of the blank 10 into a carton 90.

Figure 2:
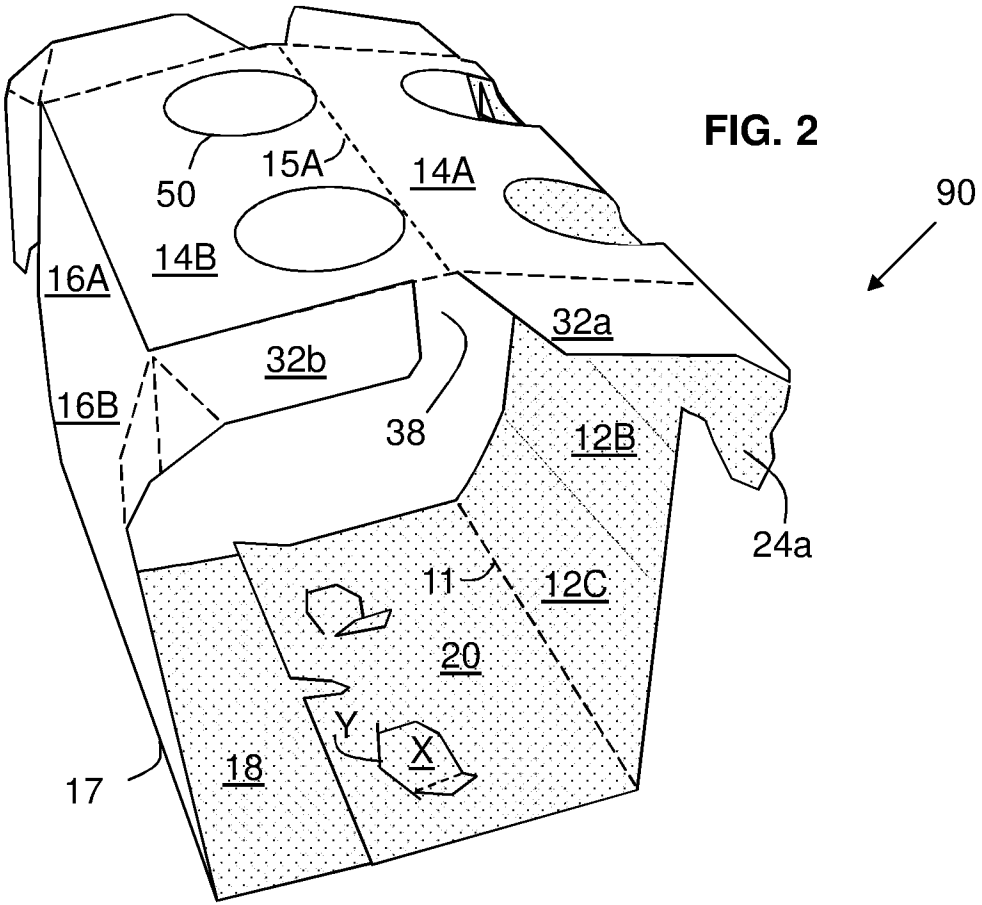
FIG. 2 illustrates a step in forming the blank of FIG. 1 into a carton by forming a tubular structure.

FIG. 2 illustrates an end view of blank 10, partially folded to form a tubular structure that may be secured by fastening together bottom panels 18, 20 by adhesive or by mechanical means such as interlocking fingers X into apertures Y. The tube is thus formed, the interior of which is defined by the panels including (from the bottom, clockwise in FIG. 2) bottom panel 18, side wall panels 16C, 16B, 16A, top panels 14B, 14A, side wall panels 12A, 12B, 12C, and bottom panel 20. The second side wall 12 is formed from the upper side wall panel 12A, the middle side wall panel 12B and the lower side wall panel 12C. The first side wall 16 is formed from the upper side wall panel 16A, the middle side wall panel 16B and the lower side wall panel 16C. The upper side wall panels, middle side wall panels, and lower side wall panels may be divided by optional crease or fold lines (shown but not numbered in FIG. 2). However, these crease or fold lines are optional and if present may divide each side wall into two or more sections as shown in FIG. 1.

Figure 3:
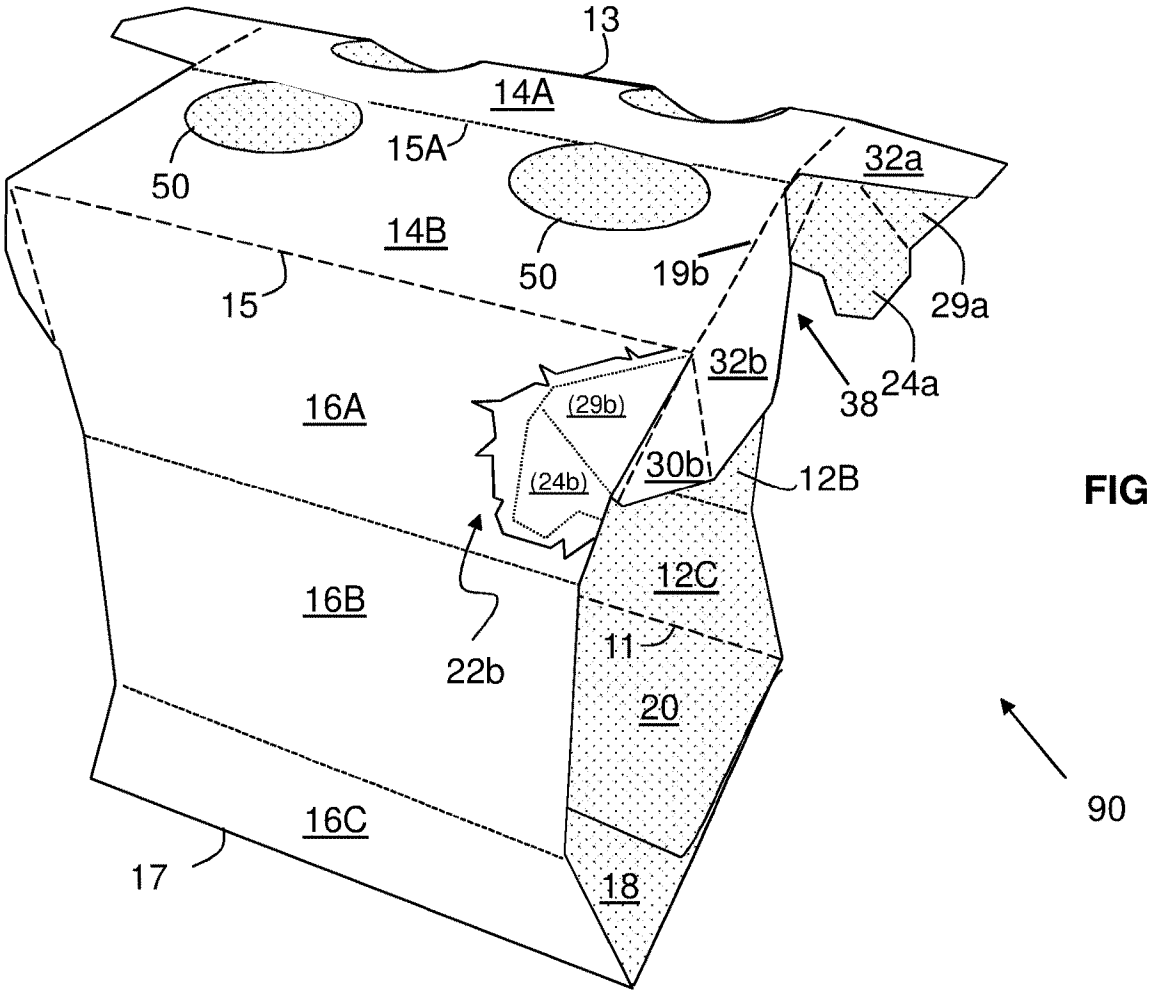
FIG. 3 illustrates a further step in forming the carton, by folding in certain gusset panels.

FIG. 3 illustrates the tubular structure rotated about 90 degrees counter-clockwise from the position in FIG. 1 to show a side view, with section 22*b* having been formed with anchoring panel 24*b* folded inwardly, while top flap 32*b* is folded downwardly about fold line 19*b*. Gusset panels 30*b*, 29*b* are folded between top flap 32*b* and anchoring panel 24*b*. Two or more of the panels 24*b*, 29*b*, 30*b* and upper side wall panel 16A may optionally be glued together to secure the end closure structure 22*b* although such gluing normally is not required. Without using glue, the panels 24*b*, 29*b*, 30*b*, 32*b* may be retained in the erected position as shown in FIG. 3 because the anchoring panel 24*b* and the gusset panel 29*b* are tucked together between the upper side wall panel 16A and one of the end articles A and frictionally secured at the tucked position. In FIG. 3, a portion of upper side wall panel 16A is cut away to better illustrate the section 22*b* of the end closure structure. Alternately, one or more of panels 24*b*, 29*b*, 30*b* may be mechanically attached to side wall panel 16A to retain the section 22*b* in the erected position. Such mechanical attachment may be achieved by stapling, by a tab and slot connection, or by other mechanical locking means.

In the embodiment wherein glue is used to secure the anchoring panel 24*b*, glue is applied to the inside surface of the anchoring panel 24*b* in an inline gluing process either manually or automatically. However, in alternative embodiments it is envisaged that the adhesive could be applied to a corresponding inner surface of side wall panel 16A to which panel 24*b* will be adhered after folding it inward. In an alternative embodiment it is envisaged that a mechanical locking means could be used in addition or alternative to adhesive. The arrangement of the flap 32*b* and panels 30*b*, 29*b*, and 24*b* allow the carton to closely or tightly engage articles A therein by folding about the curvature of the articles A.

Figure 4:
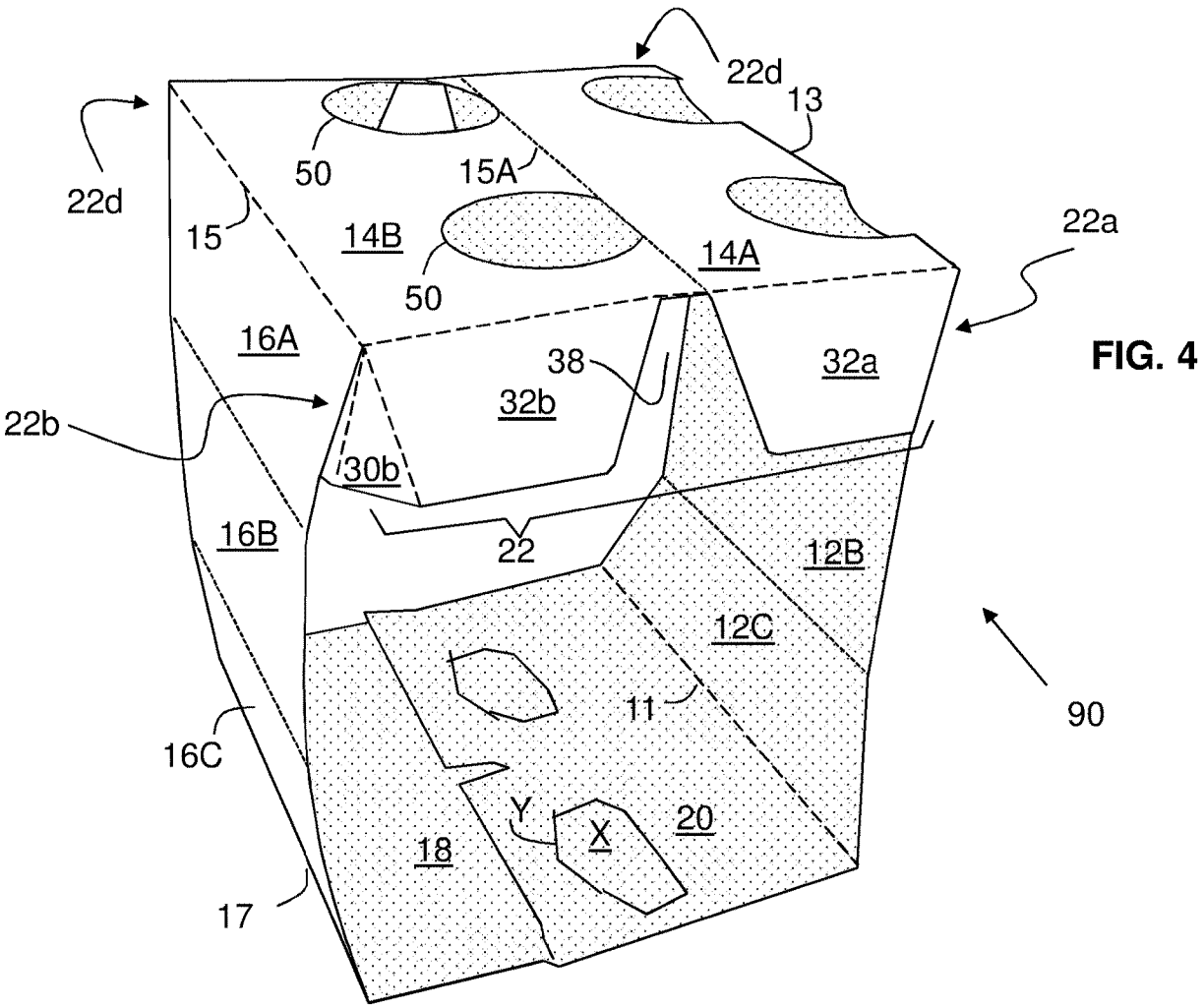
FIG. 4 illustrates the completed carton, shown for clarity without any articles within the carton.

FIG. 4 returns to an end view of the tubular structure. Unlike FIG. 2, FIG. 4 illustrates all four sections 22*a*, 22*b*, 22*c*, 22*d* of the end closure structures 22, 22 having been erected or otherwise folded. It is notable that there is a gap 38 in end closure panel 22 (between top flaps 32*a*, 32*b*) so that the sections 22*a*, 22*b* are not directly joined or connected to each other but through the top 14. This permits the top panels 14A, 14B to pivot about the fold line 15A independently and allow a tighter fit of the carton 90 to the articles within the carton. Although gap 38 is shown as having a substantial spacing between flaps 32*a*, 32*b*, the gap 38 may also be provided by having simply a cut between flaps 32*a*, 32*b* to permit them to move independently in the finished carton 90.

Figure 5B:
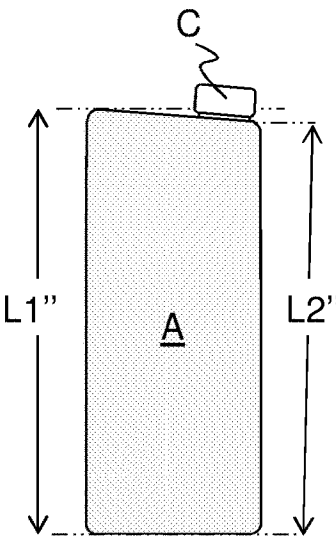
FIG. 5B illustrates a detail of the article geometry.
Figure 5A:
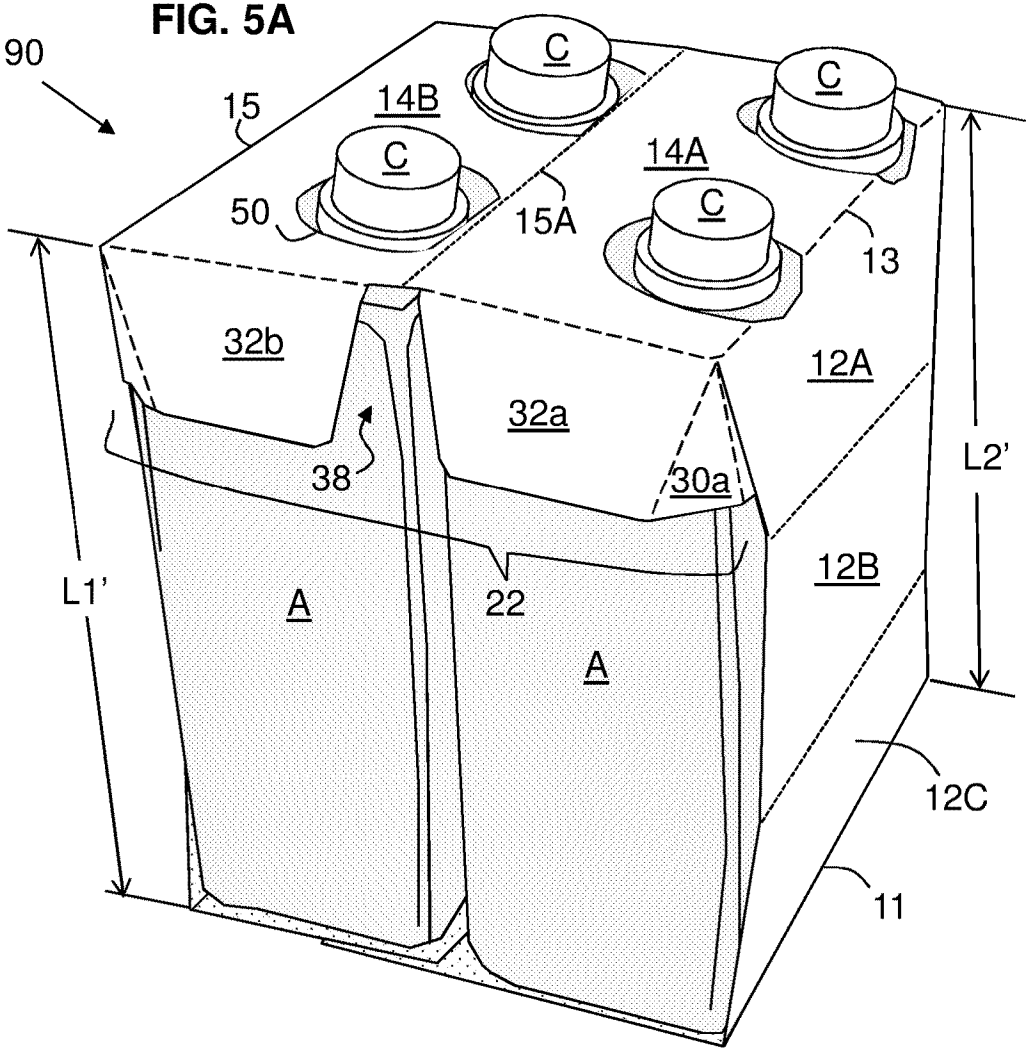
FIG. 5A illustrates the completed carton, containing articles.

FIG. 5A illustrates the finished carton 90 containing four articles A. The articles may have already been placed within the carton before completely finishing the tubular structure; however the articles are omitted from FIGS. 2-4 for clarity in understanding the structure of the carton. As seen in FIG. 5A, top flaps 32*a* and 32*b* have been folded substantially perpendicularly with regard to the respective top panels 14A, 14B. As such, dislodgement of the articles A from the carton 90 is effectively prevented.

By virtue of the angled configuration of their associated fold lines, top flaps 32*a*, 32*b* remain substantially perpendicular to opposed side walls 12, 16 whereas anchoring panels 24*a*, 24*b* are folded substantially 180° about fold line 25*a*, 25*b* such that they are in flat face contacting relationship with a respective one of opposed upper side wall panels 12A, 16A. The top flaps 32*a*, 32*b* only partially close the respective end of the carton 90, and only partially extend between the opposed side walls 12, 16.

As shown in FIGS. 5A and 5B, articles A may be constructed such that the cap C is located toward one side of the article. Although the illustrated articles A are brick packs, they may be other articles such as other aseptic containers (e.g. boxes or pouches). Other types of articles may also be held in the carton. If the articles have capped openings, apertures 50 may be located to properly receive the caps, and may optionally extend into side wall panels 12A (as shown) or 12B in order to provide best fit for cap C. However, articles with a cap more centrally positioned may also be held within carton 90, with the apertures 50 repositioned to receive the caps. If the caps are located sufficiently away from either side of the article, the apertures 50 may be located entirely on the top panels 14A, 16A.

The articles A may be approximately rectangular in cross section. However, one side of the article may be slightly taller than the other such that the top of the article A is sloping from the one side to the other. For example, as shown in FIG. 5B, the height L1" on the side remote from cap C may be slightly taller than the height L2" of the side adjacent to the cap. The heights L1", L2" could be different even if the cap were positioned centrally on the article. The corresponding lengths L1, L2 of the blank 10 (FIG. 1) may be adjusted accordingly, which results in carton 90 having the first side wall 16 with a height L1' slightly greater than the height L2' of the second side wall 12 (FIG. 5A). Adjusting the dimensions of the blank 10 and carton 90 in this manner may provide a tighter fit to the articles A. For example, in a carton for holding a 2×2 array of brick packs each sized to contain 500 ml, L1 may be approximately 6 inches, and L2 may be approximately 5⅝ inches. It will be realized that the dimensions L1" and L2" of article A may be slightly less than the corresponding dimensions L1', L2' of carton 90 (in order to fit inside the carton). Likewise the dimensions L1', L2' of carton 90 may be slightly less than corresponding dimensions L1, L2 of blank 10 (as measured between the top panel and bottom panel), due to slight bowing of the panels in the carton.

The package illustrated in FIG. 5A includes four articles A arranged in two rows of two articles each. All the four articles in the package are placed in the carton 90 in the same orientation. More specifically, articles A in the first row which are placed under the top panel 14B have their taller sides in contact with the first side wall 16 of the carton 90 and their shorter sides in contact with the articles A in the second row. The articles A in the second row which are placed under the top panel 14A have their taller sides in contact with the articles A in the first row and their shorter sides in contact with the second side wall 12 of the carton 90. The tops of the articles A in the first row slope downwardly from the location near fold line 15 (i.e. the upper end of the first side wall 16) to the articles A in the second row while the tops of the articles A in the second row slope downward from the location near the medial fold line 15A to the second side wall 12. Accordingly, the carton 90 when tightly wrapped around the articles A ends up having the top panel 14B bridging or extending between the taller sides of the articles A in the first row and the taller sides of the articles A in the second row. This allows the top panel 14B to take a position where the top panel 14B is parallel to the bottom 18, 20 while the top panel 14B is substantially spaced above the sloping tops of the articles in the first row. Top panel 14A, on the other hand, is allowed to extend along the sloping tops of the articles A in the second row due to its foldability about the medial fold line 15A. As such, the top panel 14A is not disposed parallel to the bottom 18, 20 of the carton but is inclined thereto such that it slopes downward from the medial fold line 15A to the fold line 13 at the upper end of the second side wall 12.

The gap or discontinuity 38 provided between top flaps 32*a*, 32*b* may permit the top flaps and their associated gusset panels 30*a*, 30*b* etc. along with upper side wall panels 12A, 16A to more closely fit the articles A. Also a medial fold line 15A may extend across the top panel 14 between opposed ends of the carton to provide a hinged connection (and a boundary) between top panels 14A, 14B. The fold line 15A encourages flexing or pivotal movement of the top panels 14A, 14B to permit a better fit to the articles and especially the flexing of the top panel 14A to allow the top panel 14A to extend along the sloping tops of the articles A located directly below the top panel 14A (see FIG. 5A). The medial fold line 15A may extend between the gaps 38 at the opposite ends of carton 90.

Although blank 10 and carton 90 as shown in the figures are sized and arranged to accommodate articles A arranged in an array size of 2×2, it should be understood that the invention may be utilized for array configurations other than 2×2.

It is envisaged that modification may be made in the foregoing without departing from the scope of the invention.

The blank and carton of the invention may be designed to accommodate any number of articles greater than one. However, when six or more articles are packaged, it is yet preferred to arrange the article in two rows where the articles in one row are flanked by a first side wall of the carton and the article in the other row are flanked by a second side wall of the carton. When the packaged articles have sloping tops similar to articles A, the articles in one of the rows are orientated such that the shorter sides of the articles in the one row are flanked by one of the side walls of the carton. Optionally, the articles in both the rows may be oriented such that the shorter sides of the articles in either row are flanked by the respective side wall of the carton. In such an embodiment, the taller sides of the articles in one row are disposed in contact with the taller sides of the articles in the other row such that each top panel of the carton slopes downward from the medial fold line of the top of the carton to the respective side wall of the carton.

It should be appreciated that as used herein, directive references such as "top", "bottom", "end", "side", "upper" and "lower" do not limit the respective panels to such orientation, but merely serve to distinguish these panels from one another. It should be further appreciated that any reference to hinged or foldable connections should not be construed as necessarily referring to a single fold line only, indeed it is envisaged that hinged connection can be formed from one or more of the following, a score line, a frangible line or a fold line, without departing from the scope of the invention.

As used herein, the terms "hinged connection" and "fold line" refer to all manner of lines that define hinge features of the blank, facilitate folding portions of the blank with respect to one another, or otherwise indicate optimal panel folding locations for the blank. A fold line is typically a scored line, an embossed line, or a debossed line. Any reference to hinged connection or fold line should not be construed as necessarily referring to a single fold line only; indeed it is envisaged that hinged connection can be formed from any one or more of the following, a short slit, a frangible line or a fold line without departing from the scope of the invention.

It should be understood that hinged connection and fold lines can each include elements that are formed in the substrate of the blank including perforations, a line of perforations, a line of short slits, a line of half-cuts, a single half-cut, a cut line, an interrupted cut line, slits, scores, any combination thereof, and the like. The elements can be dimensioned and arranged to provide the desired functionality. For example, a line of perforations can be dimensioned or designed with degrees of weakness to define a fold line and/or a severance line. The line of perforations can be designed to facilitate folding and resist breaking, to facilitate folding and facilitate breaking with more effort, or to facilitate breaking with little effort.

Once given the above disclosure, many other features, modifications or improvements will become apparent to the skilled artisan. Such features, modifications or improvements are, therefore, considered to be a part of this invention, the scope of which is to be determined by the following claims.

While preferred embodiments of the invention have been described and illustrated, it should be apparent that many modifications to the embodiments and implementations of the invention can be made without departing from the spirit or scope of the invention. It is to be understood therefore that the invention is not limited to the particular embodiments disclosed (or apparent from the disclosure) herein, but only limited by the claims appended hereto.

The invention claimed is:

1. A carton for packaging a plurality of articles, comprising:

top and bottom connected together by spaced side walls to form a tubular structure;

an end closure structure for at least partially closing one of opposed ends of the tubular structure, the end closure structure comprising a pair of first and second sections connected to the top at the one of the opposed ends of the tubular structure;

wherein the sections each comprises a top flap hingedly connected to the top, and the top flaps at the one of the opposed ends of the tubular structure are not directly connected to each other;

wherein the top comprises a first top panel and a second top panel, the first and second top panels being hingedly connected together by a medial fold line extending between the opposed ends of the tubular structure, wherein the first top panel and the second top panel are not coplanar with one another, wherein the first top panel is parallel to the bottom and wherein the second top panel is not parallel to the bottom.

2. The carton according to claim 1 wherein each of the top flaps is hingedly connected through at least one gusset panel to an anchoring panel positioned between an adjacent one of the side walls and an adjacent one of the articles.

3. The carton according to claim 2, wherein the anchoring panel is adhesively attached to the adjacent side wall panel.

4. The carton according to claim 2 wherein the anchoring panel is frictionally retained at a position between the adjacent one of the side walls and the adjacent one of the articles.

5. The carton according to claim 2 wherein the at least one gusset panel is triangular in shape.

6. The carton according to claim 2, wherein the at least one gusset panel comprises two gusset panels hingedly connected together.

7. The carton according to claim 1, wherein the top flaps are separated by a gap.

8. The carton according to claim 7, wherein the medial fold line extends from the gap across the top to the other end of the tubular structure.

9. The carton according to claim 7, wherein the gap comprises one selected from the group consisting of a cut and a cutout.

10. The carton according to claim 1, wherein the side walls form a first side wall and a second side wall, and the first side wall being taller than the second side wall.

11. A blank for forming a carton for packaging a plurality of articles, the blank comprising:

a plurality of panels for forming a tubular structure, the plurality of panels including first and second top panels and a bottom panel connected to the second top panel by at least one side wall panel; and an end closure structure for at least partially closing one of opposed ends of the tubular structure when the blank is erected into a set-up carton, the end closure structure comprising first and second top flaps connected to the first and second top panels respectively at the one of the opposed ends of the tubular structure, wherein the first and second top flaps are not directly connected to one another but through the first and second top panels; wherein the first and second top panels are hingedly connected together along a medial fold line extending between the opposed ends of the tubular structure, wherein the first and second top panels are not coplanar with one another in the set-up carton, wherein the first top panel is parallel to the bottom and wherein the second top panel is not parallel to the bottom.

12. The blank according to claim 11 wherein the first and second top flaps are separated by a gap.

13. The blank according to claim 12, wherein the gap comprises one selected from the group consisting of a cut and a cutout.

14. The blank according to claim 12, wherein the medial fold line extends from the gap to the other end of the tubular structure.

15. The blank according to claim 11, wherein the at least one side wall panel comprises a first set of side wall panels.

16. The blank according to claim 15, wherein the plurality of panels further include another bottom panel connected to the first top panel through a second set of side wall panels, and the first set of side wall panels is taller than the second set of side wall panels.

* * * * *